US006884378B2

(12) United States Patent
Jen

(10) Patent No.: US 6,884,378 B2
(45) Date of Patent: Apr. 26, 2005

(54) METHODS FOR MANUFACTURING SUPER MICRO FIBERS

(75) Inventor: Zo-Chun Jen, Taipei (TW)

(73) Assignee: Nan Ya Plastics Corporation, Taipei (TW)

( * ) Notice: Subject to any disclaimer, the term of this patent is extended or adjusted under 35 U.S.C. 154(b) by 264 days.

(21) Appl. No.: 10/190,040

(22) Filed: Jul. 5, 2002

(65) Prior Publication Data

US 2004/0041298 A1 Mar. 4, 2004

Related U.S. Application Data

(63) Continuation-in-part of application No. 09/853,570, filed on May 14, 2001, now abandoned.

(51) Int. Cl.[7] ..... D01D 5/34; D01F 8/12; D01F 8/14

(52) U.S. Cl. ..... 264/172.13; 264/211.16; 264/211.22; 264/211.23

(58) Field of Search ..... 264/172.13, 211.16, 264/211.22, 211.23

(56) References Cited

U.S. PATENT DOCUMENTS 5,545,475 A 8/1996 Korleski

FOREIGN PATENT DOCUMENTS

| | | |
|---|---|---|
| JP | 409429 | 5/1965 |
| JP | 417893 | 4/1966 |
| JP | 516261 | 2/1976 |
| JP | 827626 A | 1/1996 |
| JP | 417886 | 4/1996 |
| TW | 168750 | 9/1991 |
| TW | 177413 | 1/1992 |

*Primary Examiner*—Leo B. Tentoni

(74) *Attorney, Agent, or Firm*—Johnson, Lin & Associates; Chauncey B Johnson, Esq.

(57) ABSTRACT

This invention relates to methods for manufacturing super-micro fibers to produce fibers having dimensions of between 0.003–0.0003 denier per filament. The manufacturing methods include the following steps: blending polyamide-polyester mixtures; passing said polyamide-polyester mixtures through single-path and twin-screw extrusion processes; spinning said polyamide-polyester mixtures; melting and dissolving said polyamide-polyester mixtures; and separating polyester compounds from said polyester-polyamide mixtures to form polyamide compound or super-micro fibers.

19 Claims, 1 Drawing Sheet

METHODS FOR MANUFACTURING SUPER MICRO FIBERS

This is a continuation-in-part application of U.S. patent application Ser. No. 09/853,570 filed on May 14, 2001, now abandoned.

BACKGROUND OF THE INVENTION

1. Field of the Invention

The present invention relates to novel and unique methods for manufacturing super-micro fibers. More specifically, this invention relates to methods for manufacturing super-micro fibers using single-path and twin-screw extrusion processes to produce super-micro fibers having dimensions between 0.003–0.0003 denier per filament.

2. Description of the Prior Art

Super-micro fibers are very thin fibers with silk-like properties. Although thinner than silk, super-micro fibers are much more durable, less brittle and less sensitive to environmental factors such as corrosion and moisture, etc. Super-micro fibers are used in the fashion industry to produce sportswear and other forms of attires. These fibers have also been used in the electronic industry and other industrial applications seeking to avoid the wear and tear associated with the use and application of conventional fibers.

Super-micro fibers are manufactured by combining, blending and extruding two or more polymers. The final products are obtained by separating the wanted polymer(s) (the super-micro fibers) from the unwanted polymer(s) using a solvent. As starting materials, the polymers generally used are polyesters, copolyesters, polyamides and copolyamides.

Examples of polyesters, copolyesters, polyamides and copolyamides used as starting materials for producing super-micro fibers are disclosed in U.S. Pat. No. 5,555,716, which teaches that polyamides and copolyamides are well known by the general term "nylon" and are long-chain synthetic polymers containing amide (—CO—NH—) linkages along the main polymer chain. That typical polyamides include nylon 6, nylon 6/6, nylon 6/10, nylon 6/12, nylon 6T, nylon 11, nylon 12, and copolymers or mixtures thereof. That polyamides can also be copolymers of nylon 6 or nylon 6/6 and a nylon salt obtained by reacting a dicarboxylic acid component such as terephthalic acid, adipic acid, or sebacic acid with a diamine such as hexamethylene diamine. U.S. Pat. No. 5,555,716 further disclosed that suitable polyesters and copolyesters include, for example, those prepared by the condensation of aromatic dicarboxylic acids such as terephthalic acid, isophthalic acid, phthalic acid and naphthalene-2, 6-carboxylic acid, and aliphatic dicarboxylic acids such as adipic acid or their esters with diol compounds such as ethylene glycol and diethylene glycol; and that preferred polyesters include polyethylene terephthalate and polybutylene terephthalate.

Because manufacturing of super-micro fibers is highly specialized, the types of manufacturing processes used are sure to influence the overall cost of production and, more importantly, the desired dimensions of the super-micro fiber products. In Patent Nos. 177413 and 168750, Republic of China, there are disclosed processes for manufacturing super-micro fibers which used polyesters and polyamides as starting materials. The processes utilized a special spinneret plate design to spin the polyamide-polyester complex. The complex was melted and one polymer was removed to produce the micro fibers. However, such processes are limited by the spinneret plate design. A single orifice of such a design arrangement can only have 37 partings, which result in the production of micro fibers with filament dimensions of around 0.025 denier.

Japan Patent Publication Nos. 40-9429, 41-7886, 41-7893 and 51-6261 disclosed processes for manufacturing super-micro fibers. These patents collectively disclosed blending polyamide or polyester with polyethylene (PE), polypropylene (PP), or polystyrene (PS) granules. The blended mixture is spun, the continuous phase is melted and removed by solvents to obtain the super-micro fibers. These prior art processes used solvents such as xylene and toluene to dissolve the PE, the PP or the PS component (the continuous, sea-phase component) from the polyamide component (the stationary, island-phase component). A major draw-back is that solvents like xylene and toluene used in the prior art processes are known to cause serious damage to the environment, are hazardous to humans and other life forms and are relatively expensive as compared to other commercial solvents.

Other prior art processes are known to use polyamide with polyethylene terephthalate as starting materials for producing super-micro fibers. These processes do not teach adding an affinity mixture to the polyamide-polyethylene terephthalate mixture to increase affinity between the polyamide and the polyethylene terephthalate mixture components prior to blending and during blending of the polyamide-polyethylene terephthalate mixture; nor do they teach the addition of an affinity mixture which constitute a predetermined weight percent of the total reaction mixture needed to produce super-micro fiber products having dimensions between 0.003–0.0003 denier per filament. Thus these prior art processes which used polyamide and polyethylene terephthalate as starting materials were known to have encountered difficulties with their respective blending and spinning reaction process steps.

As an example, Japan Patent Publication No. 8-27626 disclosed a method for producing super-micro fibers that combines polyamide and polyethylene terephthalate, which is then spun at high temperature for quite a long time to produce the desired super-micro fibers primarily containing polyamide. Because this prior art process does not add an affinity mixture processing requires blending and spinning at a high temperature for a considerable length of time to increase the affinity between the polyamide and the polyethylene terephthalate ingredients. But in practice the processing time for blending and spinning is not long enough to enhance affinity prior to pyrolosis. That is, continuous blending and spinning at high temperature result in severe pyrolosis of the mixture's ingredients thereby affecting the spinning characteristics of the micro fibers and diminishing the quality of the yarn produced.

Prior to this present invention none of the existing prior art, individually or collectively, had disclosed methods for producing super-micro fibers comprising the following steps: blending polyamide-polyester mixtures having specific concentration ratios; adding an affinity mixture to increase affinity between ingredients within the polyamide-polyester mixtures; using single-path and twin-screw extrusion processes for extruding the polyamide-polyester mixtures; spinning and drawing the polyamide-polyester mixtures; and dissolving the polyester-mixture components from the polyamide mixture components to obtain the polyamide, super-micro fiber components having dimensions between 0.003–0.0003 denier per filament.

Accordingly, it is an object of this invention to disclose methods for manufacturing super-micro fibers which add an affinity mixture to their polyamide-polyester solution mixtures to increase affinity between the polyamide ingredients and their polyester ingredients prior to blending, during blending and during spinning of their solution mixtures.

Another object of this invention is to disclose methods for manufacturing super-micro fibers capable of reducing overall manufacturing cost with the use of single-path and twin-screw extrusion processes, capable of manufacturing at temperatures much lower than manufacturing temperatures of the prior art, and capable of producing thinner super-micro fibers having dimensions between 0.003–0.0003 denier per filament.

It is a further object of this invention to disclose methods for manufacturing super-micro fibers which use less toxic solvents such as alkaline base solvents to dissolve the sea-phase polyester components from their polyamide-polyester mixtures to form the island-phase, polyamide components or super-micro fiber products.

Still, it is a further object of this invention to disclose methods for manufacturing super-micro fibers which use solution ingredients having precise weight percent based on the weight of their respective solution mixtures, and precise ranges of melting viscosity ratios, addition ratios, spinneret packed pressures, minimum intrinsic viscosities and take-up velocities to form steady island-phase polyamides or super-micro fiber structures.

SUMMARY OF THE INVENTION

The present invention discloses methods for manufacturing super-micro fibers with dimensions between 0.003–0.0003 denier per filament. Specific dimensions of the super-micro fibers are produced by blending a polyamide-polyester mixture, performing a single-path and twin-screw extrusion on the blended polyamide-polyester mixture, spinning the mixture, performing drawing steps on the mixture, melting and dissolving the mixture and removing the sea-phase polyester components from the mixture to form the polyamide, island-phase components or the super-micro fibers.

More specifically, the present invention uses polyamide and polyethylene terephthalate as starting materials and an affinity mixture containing terephthalic acids, ethylene glycol and 5-sodium sulfodimethyl isophthalate. Additionally, the present inventive methods apply precise viscosity controls, precise spinneret packed pressures and precise take-up velocities to the polyamide-polyester mixture to produce super-micro fibers of desired dimensions.

Other objects, aspects, advantages and novel features of this invention will become more apparent from the accompanying FIGURE and the following detailed description.

DETAILED DESCRIPTION OF THE INVENTION

Figure 1:
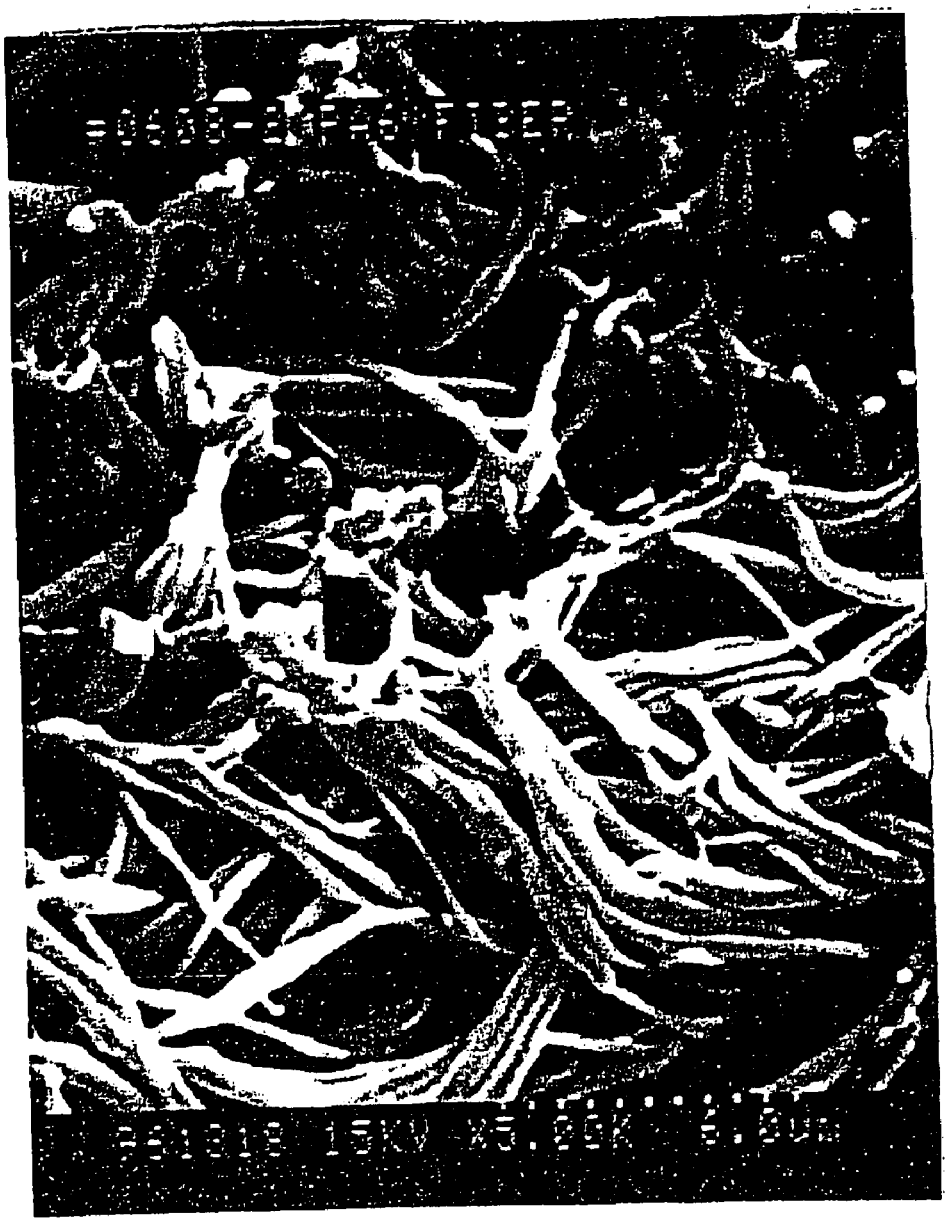
FIG. 1 shows an electron-scanned microscope photograph of nylon 6 super-micro fibers with dimensions of between 0.0014–0.003 denier per filament.

The present invention relates to methods for manufacturing super-micro fibers. Specifically, the present invention relates to methods for manufacturing super-micro fibers of dimensions between 0.003–0.0003 denier per filaments. Polyamide-polyester mixtures are combined with an affinity copolyester mixture and passed through single-path and twin-screw extrusion processes. By controlling the spinneret packed pressures and the take-up velocities of the polyamide-polyester mixtures super-micro fibers of desirable dimensions are produced. As starting materials, the methods use a polyamide ("Component A") preferably between 30–50% by weight, a copolyester component ("Component B") preferably between 40–75% by weight and an affinity copolyester component ("Component C") preferably between 5–10% by weight.

Component B is a granules mixture of terepthalic acids, ethylene glycol with diol and diacids or isophthalate compounds. Component B is added to the polyamide-polyester mixtures at an addition ratio of between 5–40% per mole to decrease the melting point and melting viscosity of the polyamide-polyester mixtures during processing, while maintaining the desired molecular weight of the polyester so as to maintain the strength of the spun micro fibers after processing is complete.

Maintaining the intrinsic viscosity of Component B during processing to $\geqq 0.5$ enhances its melting viscosity during manufacturing. If the addition ratio of Component B is greater than 40% per mole, the polyester will suffer premature phase separation from the polyamide-polyester mixtures. If the melting point of Component B is so low such that the addition ratio is lower than 5% per mole, the polyamide-polyester mixtures are difficult to crystalize and the individual fiber often adhere to each other during processing.

Component C of the present invention comprises terepthalic acid and ethylene glycol to which 5-sodium sulfodimethyl isophthalate is added, preferably, between the ratios of 0–1.0% per mole. The copolyester affinity mixture component serves to enhance the affinity between Component A and Component B. The affinity between the components is achieved when sulfonic acids groups from the mixtures containing the copolyesters polarize and absorb the polyamide resulting in an enhanced degree of affinity.

Experiments have shown that an affinity mixture containing more than 1% per mole of the 5-sodium sulfodimethyl isophthalate results in the radii and pitches of the island-phase components of the polyamide-polyester mixtures, prior to removing the polyester sea-phase components, being considerably smaller and vice-versa. Having smaller than desired radii and pitches of pre-separation island-phase components create difficulties in separating the sea-phase components from the island-phase components to form the super-micro fibers. To obtain steady polyamide island-phase components and more fluid polyester sea-phase components one has to control the blending ratios, weight compositions and melting viscosity ratios of the polyamide component (Component A), the polyester component (Component B), and the affinity polyester mixture (Component C).

In general, components with the higher viscosity are apt to become the island-phase and components with lower viscosity are apt to become the sea-phase and are more mobile or fluid. This invention desires to have increased number of island-phase components during processing to decrease losses resulting from melting, dissolving and removing the sea-phase components when forming the super-micro fibers. To accomplish the latter, the melting viscosity ratios of the island-phase components are raised considerably. In contrast, the copolyesters (Component B & C) should possess a low melting viscosity ratio so as to be effectively removed. Therefore, the melting viscosity ratios of the copolyesters to that of the polyamides must be maintained within a certain range to enable the polyamides to form island-phase components during and after separation. A desired melting viscosity ratio of the polyamide components and polyester components at process temperature should preferably exist between 4–10.

In a first preferred embodiment, super-micro fibers are manufactured by blending Component A, Component B and Component C. The blended mixture is then passed through single path and twin-screw extrusion process steps until a satisfactory degree of extrusion is achieved. Unlike double-path extrusion, which uses separate extruders, single-path extrusion is economical and result in thinner super-micro fibers. The polyamide-polyester mixture containing the affinity mixture component is spun and subsequently placed through drawing process steps. Final super-micro fibers of between 0.003–0.0003 denier per filament are produced by dissolving the more viscous sea-phase polyester components (Components B & C) of the polyamide-polyester mixture to form the island-phase polyamide components or super-micro fibers. Rather than toluene or xylene, as used in the prior art, the present invention uses alkaline-based solvents such as sodium hydroxide to dissolve the sea-phase from the island-phase, as alkaline solvents are less toxic to the environment, less toxic to humans and less toxic to other life forms. Spinning is usually performed at a spinneret packed pressure of between 70–130 kg/cm$^2$ and polyamide-polyester mixture take-up velocities of between 600–1500 m/min.

In a second preferred embodiment, the polyamide-polyester mixture containing Components A & B are blended with 5–10% by weight of Component C, passed through single-path and twin-screw extrusion steps, spun and passed through a series of drawing steps. The island-phase polyamides or super-micro fiber components, preferably between 0.003–0.0003 denier per filament, are obtained by dissolving the sea-phase more viscous polyester components (Component B & C) to form the island-phase, polyamides or super-micro fiber components. Like the previous embodiment, spinning is performed at a spinneret packed pressure of between 70–130 kg/cm$^2$ and the polyamide-polyester mixture take-up velocities are set between 600–1500 m/min.

In a third preferred embodiment, which is the best mode of the invention, super-micro fibers are produced having dimensions of between 0.003–0.0003 denier per filament by blending the following: 30–50% by weight of Compound A; 40–65% by weight Component B; and 5–10% by weight of Component C.

First, in this embodiment having a polyamide mixture of 30–50% by weight of the total weight of the polyamide-polyester mixture is sure to avoid unexpected consequences, such as the presence of the sea-phase components in the island-phase components and the island-phase components existing in the sea-phase components. Polyamide by weight of over 50% of the total weight of the polyamide-polyester mixture often results in the existence of the sea-phase component in the island-phase component and vice versa. Similarly, having a polyamide mixture less than 30% by weight of the total polyamide-polyester mixture often results in the production of thicker super-micro fibers than desired and the desired dimensions of between 0.003–0.0003 denier per filaments are often not realized.

Second, in this embodiment having a copolyester mixture of between 40–65% per weight of the total weight of the polyamide-polyester mixture have been shown to produce desired super-micro fibers of between 0.003–0.0003 denier per filament. Having the desired range by weight of Component B prevents manufacturing irregularities during and after final production of the super-micro fibers, such as having the sea-phase components existing in the island-phase components and vice versa.

Third, in this embodiment, the percent concentration of the isophthalate compound of the affinity mixture is preferably less or equal to 1%. Having the affinity mixture over 10% by weight of the total polyamide-polyester mixture often results in having the island-phase radius and pitch components of the super-micro fibers being considerable smaller than desired. Smaller island-phase radii and pitches increase difficulties in separating the copolyesters mixture components (Component B & C) from the polyamide component (Component A) during the melting, dissolving and removing phases of the process. Similarly, having an affinity mixture less than 5% by weight of the total mixture complex often results in uneven distribution between the polyamide and the copolyester components.

To enhance distribution, the melting viscosity of the affinity mixture is controlled. The subsequent blended mixture containing 30–50% by weight of polyamide (Component A), 40–65% by weight of copolyester (Component B) and 5–10% by weight of the affinity mixture (Component C) containing terepthtalic acid, ethylene glycol and 5-sodium sulfodimethyl isophthalate of preferably less or equal to 1% is subsequently passed through single-path and twin-screw extrusion process steps. The resulting products are spun and passed through drawing processes. The subsequent products are melted and dissolved. The sea-phase polyester components comprising 40–65% by weight of the copolyester and 5–10% by weight of the affinity mixture are melted, dissolved and removed to form island-phase, super micro fibers having dimensions between 0.003–0.0003 denier per filament.

The 40–65% by weight copolyester (Component B) is added to the entire mixture and has addition ratios of between 5–40%. Holding the intrinsic viscosity of the 40–65% copolyester mixture to greater than 0.5 aids in the production of super-micro fibers having dimensions of between 0.003–0.0003 denier per filaments. The process of this embodiment is performed at a spinneret packed pressure of 70 kg/cm$^2$ and polyamide-polyester take-up velocities of between 600–1500 m/min. The intrinsic viscosity of the copolyester mixture was determined by the use of phenol-/m-cresol. The analysis method used a phenol-/m-cresol solvent having a polymer concentration of 0.5 grams/100 ml, which was analyzed at room temperature.

Below, the following examples are provided to further illustrate the characteristics of the present invention. The examples are provided only to illustrate the present invention and should not be construed as limitations.

EXAMPLE I

In this example, the following weight percentages, mole percentages, viscosities (intrinsic and melting) and other measurements, etc. were used: 50% by weight of nylon 6 (Component A) with a relative viscosity of 2.47, wherein the viscosity was measured using 1% weight sulfuric acid; 45 % by weight of copolyester (Component B) containing polyethylene terephthalate (PET) and 13% per mol of adipic acid, wherein the intrinsic viscosity of the component B is 0.508 and the melting viscosity is 365 poise at 270° C.; and 5% by weight of copolyester (Component C) containing polyethylene terephthalate (PET) with an intrinsic viscosity of 0.503, 10% per mol of isophthalic and 0.3% per mol of 5-sodium sulfodimethyl isophthalate.

Components A, B and C were mixed in a rolling barrel mixer and dried; they were then melted and blended using a single-path and twin-screw extruder having L/D=36 and D=37 mm at 270° C. The blended granules were dried with nitrogen gas at 130° C. for eight hours and subsequently spun at 265° C. The spinneret packed pressure was 74 kg/cm$^2$. The spinneret plate had 484 holes. The L/D of the spinneret hole was 0.5 mm/0.3 mm. The polyamide-polyester mixture take-up velocity was 800 ml/min. After the first round of spinning the super-micro fibers dimensions were determined as 13 denier per filament. The polyesters comprising components B &C were melted and removed using 5% NaOH at 110° C. for sixty minutes. In FIG. 1, using a Hitachi electron scanning microscope, an example of the final product, a photograph of nylon 6 super-micro fibers enlarged 5000-fold and having dimensions between 0.0014–0.003, is shown.

EXAMPLE II

In this example, the following weight percentages, mole percentages, viscosities (intrinsic and melting) and other measurements, etc. were used: 50% by weight of nylon 66 (Component A) with relative viscosity of 2.50; 40% by weight of copolyester (Component B) containing polyethylene terephthalate (PET) with intrinsic viscosity of 0.512 and 10% per mol of adipic acid; and 10% by weight of copolyester (Component C) containing polyethylene terephthalate (PET), 10% per mol of isophthalic and 0.3% per mol of 5-sodium sulfodimethyl isophthalate, and wherein Component C has an intrinsic viscosity of 0.503.

The blending and spinning conditions are similar to those practiced in Example 1. The spinneret packed pressure is 120 kg/cm$^2$ and the polyamide-polyester take-up velocity is 600 m/min. The polyesters (Components B & C) were melted and subsequently removed using NaOH. The nylon 66 super micro fibers were determined to have dimensions of between 0.0035–0.0014 denier per filament.

While particular embodiments of this invention have been shown in FIG. 1 and the description above, it will be apparent that many changes may be made in the form, arrangement and positioning of the various elements. In consideration thereof it should be understood that the preferred embodiments of this invention disclosed herein are intended to be illustrative only and not intended to limit the scope of the invention. Any modifications are within the spirit and scope of the invention, which are limited and defined only by the appended claims.

What is claimed is:

1. A method for manufacturing super-micro fibers having dimensions between 0.003 and 0.0003 denier per filament comprising the steps of:

(a) Blending polyamide-polyester mixtures containing the following:
  (i) 30–50% by weight mixture of polyamide compounds;
  (ii) 40–65% by weight mixture of terephthalic acid, ethylene glycol with diol and diacids or isophthalic compounds; and
  (iii) 5–10% by weight of affinity mixture containing terephthalic acid, ethlylene glycol and 5-sodium sulfodimethyl isophthalate compounds;

(b) Performing single-path and twin-screw extrusion of said polyamide-polyester mixtures;

(c) Spinning said single-path and twin-screw extruded polyamide-polyester mixtures;

(d) Performing drawing processes of said single-path and twin screw extruded polyamide-polyester mixtures; and (e) Melting, dissolving and removing sea-phase polyester components from said polyamide-polyester mixtures to form island-phase, polyamide components or super-micro fibers having dimensions between 0.003 and 0.0003 denier per filament.

2. The method for manufacturing super-micro fibers according to claim 1, wherein during the manufacturing method said 30–50% by weight mixture and said 40–65% by weight mixture have melting viscosity ratios of between 4–10.

3. The method for manufacturing super-micro fibers according to claim 1, wherein said 40–65% by weight mixture has an addition ratio of between 5–40 mol %.

4. The method for manufacturing super-micro fibers according to claim 2, wherein said 40–65% by weight mixture has an intrinsic viscosity above 0.5.

5. The method for manufacturing super-micro fibers according to claim 1, wherein 1% of said 5-sodium sulfodimethyl isophthalate is added to said 5–10% affinity mixture.

6. The method for manufacturing super-micro fibers according to claim 1, wherein spinning is performed at a spinneret pack pressure of 70 Kg/cm$^2$.

7. The method for manufacturing super-micro fibers according to claim 1, wherein spinning is performed at a spinneret pack pressure of 70 Kg/cm$^2$ and take-up velocities of between 600–1500 m/min.

8. The method for manufacturing super-micro fibers according to claim 3, wherein alkaline solvents are used to separate the sea-phase components from the island-phase components or super-micro fiber products.

9. A method for manufacturing super-micro fibers having dimensions between 0.003 and 0.0003 denier per filament comprising the steps of:

(a) Blending polyamide-polyester mixtures containing the following:
  (i) mixture of polyamide compounds;
  (ii) mixture of terephthalic acid, ethylene glycol with diol and diacids or isophthalic compounds; and
  (iii) 5–10% by weight of affinity mixture containing terephthalic acid, ethlylene glycol and $\leqq 1\%$ 5-sodium sulfodimethyl isophthalate compounds;

(b) Performing single-path and twin-screw extrusion of said polyamide-polyester mixtures;

(c) Spinning said single-path and twin-screw extruded polyamide-polyester mixtures;

(d) Performing drawing processes of said single-path and twin screw extruded polyamide-polyester mixtures; and (e) Melting, dissolving and removing sea-phase polyester components from said polyamide-polyester mixtures to form island-phase, polyamide components or super-micro fibers having dimensions between 0.003 and 0.0003 denier per filament.

10. The method for manufacturing super-micro fibers according to claim 9, wherein said mixture of polyamide compounds is 30–50% by weight.

11. The method for manufacturing super-micro fibers according to claim 9, wherein said mixture of terephthalic acid, ethylene glycol with diol and diacids or isophthalic compound is 40–65% by weight.

12. The method for manufacturing super-micro fibers according to claim 11, wherein said 40–65% by weight mixture has an addition ratio between 5–40 mol % and an intrinsic viscosity above 0.5.

13. The method for manufacturing super-micro fibers according to claim 12, wherein alkaline solvents are used to separate the sea-phase components from the island-phase components or super-micro fiber products.

14. The method for manufacturing super-micro fibers according to claim 13, wherein spinning is performed at a spinneret packed pressure of 70 $Kg/cm^2$ and a take-up velocity of between 600–1500 m/min.

15. A method for manufacturing super-micro fibers having dimensions between 0.003 and 0.0003 denier per filament comprising the steps of:

(a) Blending polyamide-polyester mixtures containing the following:

(i) mixture of polyamide compounds;

(ii) mixture of terepthalic acid, ethylene glycol with diol and diacids or isophthalic compounds; and (iii) affinity mixture containing terephthalic acid, ethylene glycol and $\leqq 1\%$ 5-sodium sulfodimethyl isophthalate compounds;

(b) Performing single-path and twin-screw extrusion of said polyamide-polyester mixtures;

(c) Spinning said single-path and twin-screw extruded polyamide-polyester mixtures;

(d) Performing drawing processes of said single-path and twin screw extruded polyamide-polyester mixtures; and (e) Melting, dissolving and removing sea-phase polyester components from said polyamide-polyester mixtures to form island-phase, polyamide components or super-micro fibers having dimensions between 0.003 and 0.0003 denier per filament.

16. The method for manufacturing super-micro fibers according to claim 13, wherein said mixture of polyamide compounds is 30–50% by weight, said mixture of terephthalic acid, ethylene glycol with diol and diacids or isophthalic compunds is 40–65% by weight and said affinity mixture is 5–10% by weight.

17. The method for manufacturing super-micro fibers according to claim 16, wherein said 40–65% by weight mixture has an addition ratio between 5–40 mol % and an intrinsic viscosity above 0.5.

18. The method for manufacturing super-micro fibers according to claim 17, wherein spinning is performed at a spinneret packed pressure of 70 $Kg/cm^2$ and a take-up velocity of between 600–1500 m/min.

19. The method for manufacturing super-micro fibers according to claim 17, wherein alkaline solvents are used to separate the sea-phase components from the island-phase components or super-micro fiber products.

* * * * *